US007922056B2

(12) United States Patent
Kishi et al.

(10) Patent No.: US 7,922,056 B2
(45) Date of Patent: Apr. 12, 2011

(54) STAPLE CARTRIDGE AND STAPLE LEG CHIP PROCESSING APPARATUS

(75) Inventors: Kazuhiko Kishi, Tokyo (JP); Toshio Shimizu, Tokyo (JP); Katsuya Hakozaki, Tokyo (JP); Kazuo Higuchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 61 days.

(21) Appl. No.: 11/793,026

(22) PCT Filed: Dec. 14, 2005

(86) PCT No.: PCT/JP2005/022974

§ 371 (c)(1),
(2), (4) Date: Jun. 14, 2007

(87) PCT Pub. No.: WO2006/064855

PCT Pub. Date: Jun. 22, 2006

(65) Prior Publication Data

US 2008/0223899 A1 Sep. 18, 2008

(30) Foreign Application Priority Data

Dec. 15, 2004 (JP) ..... P. 2004-363688

(51) Int. Cl.
*B25C 7/00* (2006.01)

(52) U.S. Cl. ..... 227/79; 227/108; 227/155; 83/167; 83/694; 83/923

(58) Field of Classification Search ..... 227/79, 227/108, 155; 83/167, 613, 694, 923
See application file for complete search history.

(56) References Cited

U.S. PATENT DOCUMENTS

| | | | | |
|---|---|---|---|---|
| 4,844,319 | A * | 7/1989 | Kurosawa | 227/79 |
| 5,113,732 | A * | 5/1992 | Hansch | 83/154 |
| 5,273,199 | A * | 12/1993 | Logtens | 227/87 |
| 5,346,114 | A * | 9/1994 | Udagawa et al. | 227/120 |
| 5,590,828 | A * | 1/1997 | Stauber | 227/81 |
| 6,036,074 | A * | 3/2000 | Manabe | 227/155 |
| 6,250,531 | B1 * | 6/2001 | Yagi | 227/79 |
| 6,607,188 | B2 * | 8/2003 | Sato et al. | 270/58.09 |
| 6,981,626 | B1 * | 1/2006 | Tsai | 227/79 |
| 2007/0246504 | A1 * | 10/2007 | Kanai | 227/155 |
| 2008/0128466 | A1 * | 6/2008 | Hasegawa et al. | 227/117 |
| 2008/0135597 | A1 * | 6/2008 | Kishi et al. | 227/120 |

FOREIGN PATENT DOCUMENTS

| | | |
|---|---|---|
| EP | 0 051 395 | 5/1982 |
| EP | 0 266 700 | 5/1988 |
| EP | 0 995 561 | 4/2000 |
| JP | 64-11428 | 2/1989 |
| JP | 3-25931 | 6/1991 |
| JP | 10-128683 | 5/1998 |
| JP | 2001-105347 | 4/2001 |

* cited by examiner

*Primary Examiner* — Rinaldi I Rada
*Assistant Examiner* — Gloria R Weeks
(74) *Attorney, Agent, or Firm* — Drinker Biddle & Reath LLP

(57) ABSTRACT

A stapler 1 is provided with a cutter unit 12 for cutting a leading end portion of a staple leg projected to a back face side of sheets. A staple cartridge 20 containing a number of staples is formed with a chip containing portion 23 for containing a chip of the staple leg. The chip of the staple leg cut by the cutter unit 12 is guided into the chip containing portion 23 of the staple cartridge 20 by a chute 22 formed on the cutter unit 12. The chip of the staple leg is collected in the staple cartridge 20.

9 Claims, 7 Drawing Sheets

STAPLE CARTRIDGE AND STAPLE LEG CHIP PROCESSING APPARATUS

TECHNICAL FIELD

The present invention relates to a stapler including a cutter unit for cutting a leading end portion of a staple leg struck out by a strike mechanism and penetrated through sheets to be bound in accordance with a thickness of the sheets to be bound (sheets), particularly relates to a staple cartridge and a processing apparatus of a staple leg chip for preventing a chip of the staple leg cut by the cutter unit from being scattered in the stapler.

BACKGROUND ART

In a stapler which is built into a printer or a copier or a finisher or the like for binding a plurality of sheets of paper after printed or copied or the like, there is a stapler which cuts a leading end portion of a staple leg penetrated through the sheets by a cutter unit. Thereby, thin sheets through thick sheets are capable of being bound by a stable shape by making a length of the staple leg projected from the sheets constant. The cutter unit is constituted by a fixed cutter and a movable cutter movable relative to the fixed cutter. The leading end portion of the staple leg advancing between the two cutters by penetrating the sheets is cut such that the length of the staple leg portion penetrating from the sheets becomes substantially constant.

According to the stapler which cuts the leading end portion of the staple leg by the cutter unit, by scattering the chip of the staple leg cut by the cutter unit, there is a concern of posing a problem of bringing about an operational failure by being caught in an operating mechanism of a drive gear or a link or the like in the stapler or a printer or a copier or a finisher or the like, or dropping the chip onto a circuit board for control to shortcircuit the circuit to destruct. Therefore, a stapler of JP-Y-03-025931 is provided with a chip processing apparatus for gathering a chip of a staple leg cut by a cutter unit to a predetermined portion. According to the chip processing apparatus of JP-Y-03-025931, a chip discharging portion of the cutter unit is inclinedly arranged with a containing vessel for containing the chip, and the chip of the staple leg cut by the cutter unit is gathered into the containing vessel. An opening portion formed at a lower end of the containing vessel is provided with a lid member normally closing the opening portion. The chip stored in the containing vessel is discharged to outside by opening the lid member as necessary.

In a stapler which is built into a printer or a copier or a finisher or the like and arranged along a path of carrying sheets in the apparatus and binds printed or copied sheets, a number of times of binding staples is large so that the staple leg is cut at each time of binding. Therefore, a large amount of chips are generated. The staple leg chip processing apparatus of JP-Y-03-025931 is formed with the containing vessel at the chip discharging portion of the cutter unit, and therefore, a space of installing the containing vessel having a large volume capable of containing a large amount of cut chips is needed in the printer or the copier or the like including the stapler. Moreover, the chip gathered in the containing vessel is discharged by opening the lid member formed at the lower end portion of the containing vessel. Therefore, there is restriction in installing the containing vessel, and a degree of freedom of designing the printer or the copier or the like or the finisher is restricted.

DISCLOSURE OF THE INVENTION

One or more embodiments of the invention provide a chip processing apparatus of a staple leg with no need of forming a volume of a containing portion for storing a chip of a staple leg cut by a cutter unit to be large and preventing the chip from being scattered in a stapler or an apparatus including the stapler.

According to one or more embodiments of the invention, a staple cartridge mounted attachably and detachably to and from a stapler for striking out a staple to sheets, cutting a leading end portion of a staple leg projected to a back face side of the sheets by a cutter unit, then bending the staple leg penetrated through the sheets by a clincher mechanism portion along a back face of the sheets is provided with a containing portion for containing a number of the staples to be supplied to the strike mechanism portion, and a chip containing portion for containing a chip of the staple leg cut by the cutter unit.

According to one or more embodiments of the invention, in a stapler configured so that a staple cartridge containing a number of staples is attachably and detachably mounted thereto, and provided with a strike mechanism portion for striking out the staple drawn out from the staple cartridge and supplied to a striking portion to sheets, a clincher mechanism portion operably supported to be proximate to and remote from the strike mechanism portion for bending the staple leg penetrated through the sheets along a back face of the sheets, and a cutter unit formed in the clincher mechanism portion for cutting a leading end portion of the staple leg projected to the back face side of the sheets, a staple leg chip processing apparatus is provided with: a chip containing portion formed at the staple cartridge for containing the chip of the staple leg cut by the cutter unit, and a chute formed at the cutter unit for guiding the chip of the staple cut by the cutter unit into the chip containing portion. The chip of the staple leg is collected in the staple cartridge.

Further, according to one or more embodiments of the invention, the chute for guiding the chip of the staple leg into the chip containing portion is formed in a shape of a cylinder formed with an opening portion directed in a lower direction, the opening portion of the chute is formed with an opening and closing lid normally closing the opening portion, the chip is deposited in the chute, and when the clincher mechanism portion is operated in a direction of the staple strike mechanism portion, a lower end portion of the chute is made to advance into the chip containing portion of the staple cartridge, the opening portion is opened by operating the clincher mechanism portion to be proximate to the staple strike mechanism portion, and the chip deposited in the chute is discharged into the chip containing portion of the staple cartridge.

According to a staple cartridge of one or more embodiments of the invention, a staple cartridge containing a number of staples and mounted attachably and detachably to and from a stapler which cuts a leading end portion of a staple leg by a cutter unit is formed with a chip containing portion for containing a chip of the staple leg cut by the cutter unit. Therefore, by collecting the chip of the staple leg cut by the cutter unit in the chip containing portion of the staple cartridge, at each time of replacing the staple cartridge for replenishing the staple, the chip stored in the chip containing portion can be discharged to outside of the stapler. As a result, it is not necessary to form a chip containing portion having a large capacity in the stapler or a printer or a copier or a finisher or the like including the stapler.

Moreover, according to a staple leg chip processing apparatus of one or more embodiments of the invention, a staple cartridge is formed with a chip containing portion for containing a chip of a staple leg cut by the cutter unit, the chip of the staple leg cut by the cutter unit is guided into the chip containing portion of the staple cartridge by a chute formed at the cutter unit, and the chip of the staple leg is collected in the staple cartridge. Therefore, at each time of replacing the staple cartridge for replenishing the staple, the chip stored in the chip containing portion can be discharged to outside of the stapler. As a result, a volume of the chip containing portion formed at the staple cartridge may be set in accordance with an amount of staple members contained in the staple cartridge, it is not necessary to form a containing portion having a large capacity in the stapler or a printer or a copier or a finisher or the like including the stapler. Further, it is not necessary to newly form a mechanism for discharging the chip at a printer or a copier or a finisher or the like.

Further, according to one or more embodiments of the invention, the chute for guiding the chip of the staple leg into the chip containing portion is formed in a shape of a cylinder formed with an opening portion directed in a lower direction. The opening portion of the chute is formed with an opening and closing lid normally closing the opening portion. The chip is deposited in the chute. When the clincher mechanism portion is operated in a direction of the staple strike mechanism portion, a lower end portion of the chute advances into the chip containing portion of the staple cartridge. The opening portion is opened by operating the clincher mechanism portion to be proximate to the staple strike mechanism portion, and the chip deposited in the chute is discharged into the chip containing portion of the staple cartridge. Therefore, the chip cut by the cutter unit formed on a side of the pivotably operated clincher can firmly be discharged into the chip containing portion formed at the staple cartridge mounted to a side of the strike mechanism portion. As a result, the chip is not scattered to in the stapler or in a printer or a copier or a finisher or the like including the stapler, and an operational failure by the chip can be prevented from being brought about. Further, when the staple cartridge is replaced, the chute for guiding the chip into the chip containing portion is arranged by being separated from the staple cartridge, and therefore, an operation of attaching and detaching the staple cartridge can easily be carried out.

Other aspects and advantages of the invention will be apparent from the following description and the appended claims.

DESCRIPTION OF REFERENCE NUMERALS AND SIGNS

Figure 1:
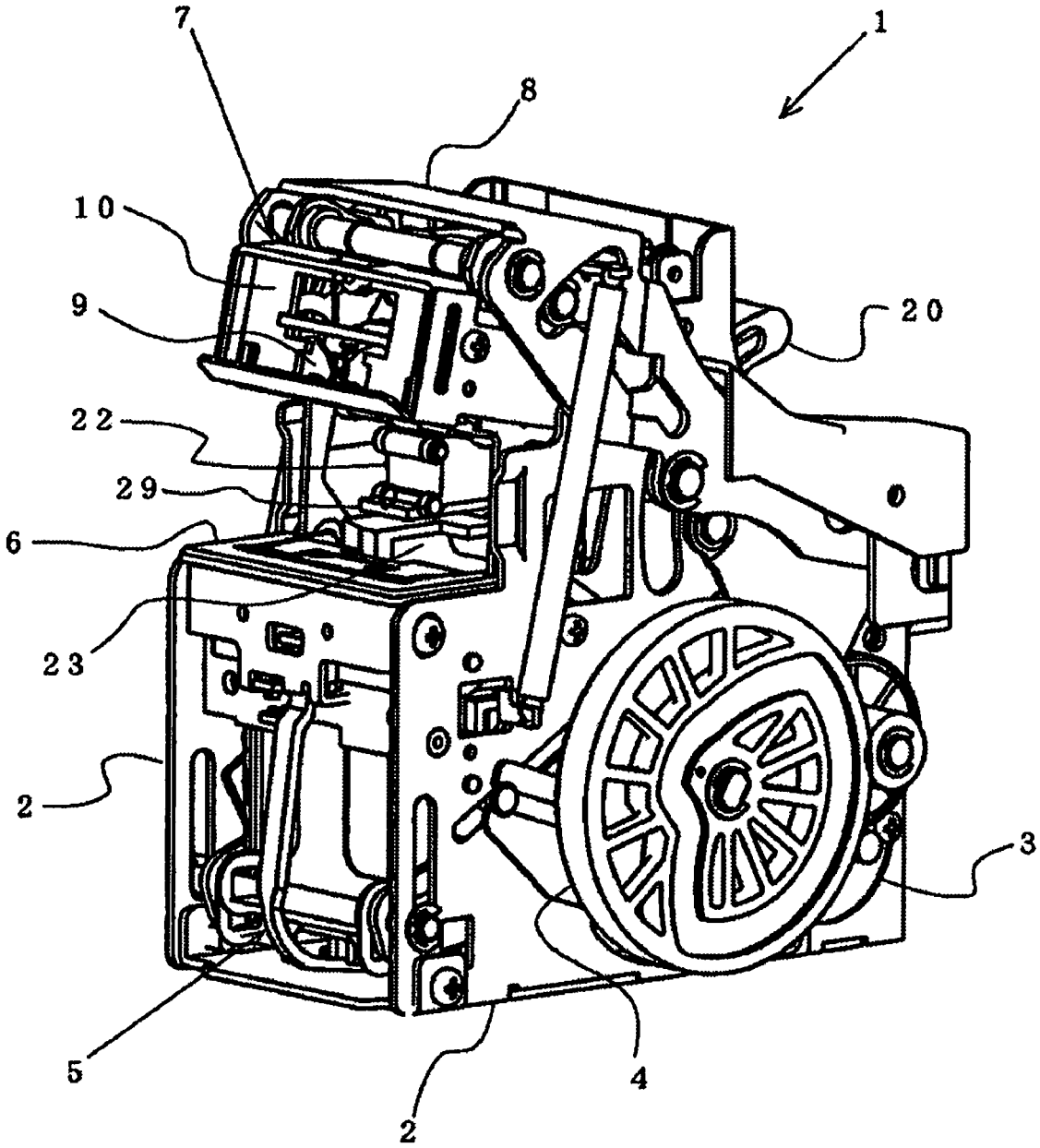
FIG. 1 is a perspective view of a stapler embodying a staple leg chip processing apparatus.

1 . . . stapler
5 . . . strike mechanism portion
7 . . . clincher mechanism portion
12 . . . cutter unit
20 . . . staple cartridge
21 . . . discharging portion
22 . . . chute
23 . . . chip containing portion
26 . . . first chute
27 . . . second chute
27*a* . . . opening

BEST MODE FOR CARRYING OUT THE INVENTION

Embodiments of the invention will be explained in reference to the drawings as follows.

Embodiment 1

Figure 2:
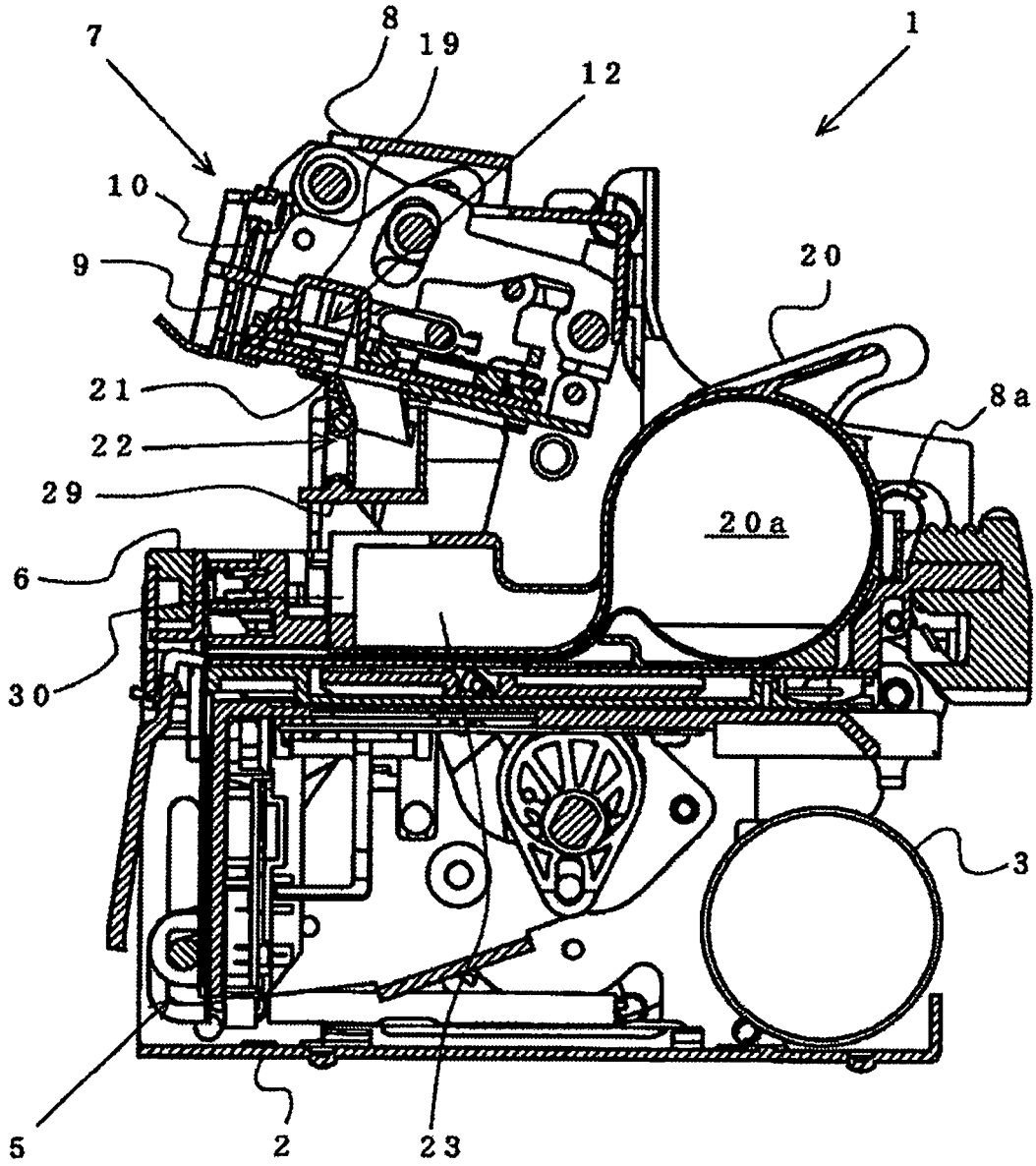
FIG. 2 is a vertical sectional side view of the stapler of FIG. 1.

FIG. 1 and FIG. 2 show a stapler 1 embodying a chip processing apparatus of a staple leg. The stapler 1 of the embodiment is a built-in type stapler for binding a plurality of sheets of paper after printed or copied or the like in a printer or a copier or a finisher or the like. In a machine frame 2 forming an outer shell of the stapler 1, an electric motor 3 is contained. A drive cam 4 driven to rotate by the electric motor 3 is arranged on a side face of the machine frame 2. A lower portion of the machine frame 2 is formed with a strike mechanism portion 5 driven by the drive cam 4 for striking out a staple formed in a U-shape to sheets. Further, an upper face of the machine frame 2 is formed with a table 6 for mounting sheets. The staple is struck from a lower face side of the table 6 to sheets to be bound (sheets) arranged on the table 6 by the strike mechanism portion 5.

Figure 3:
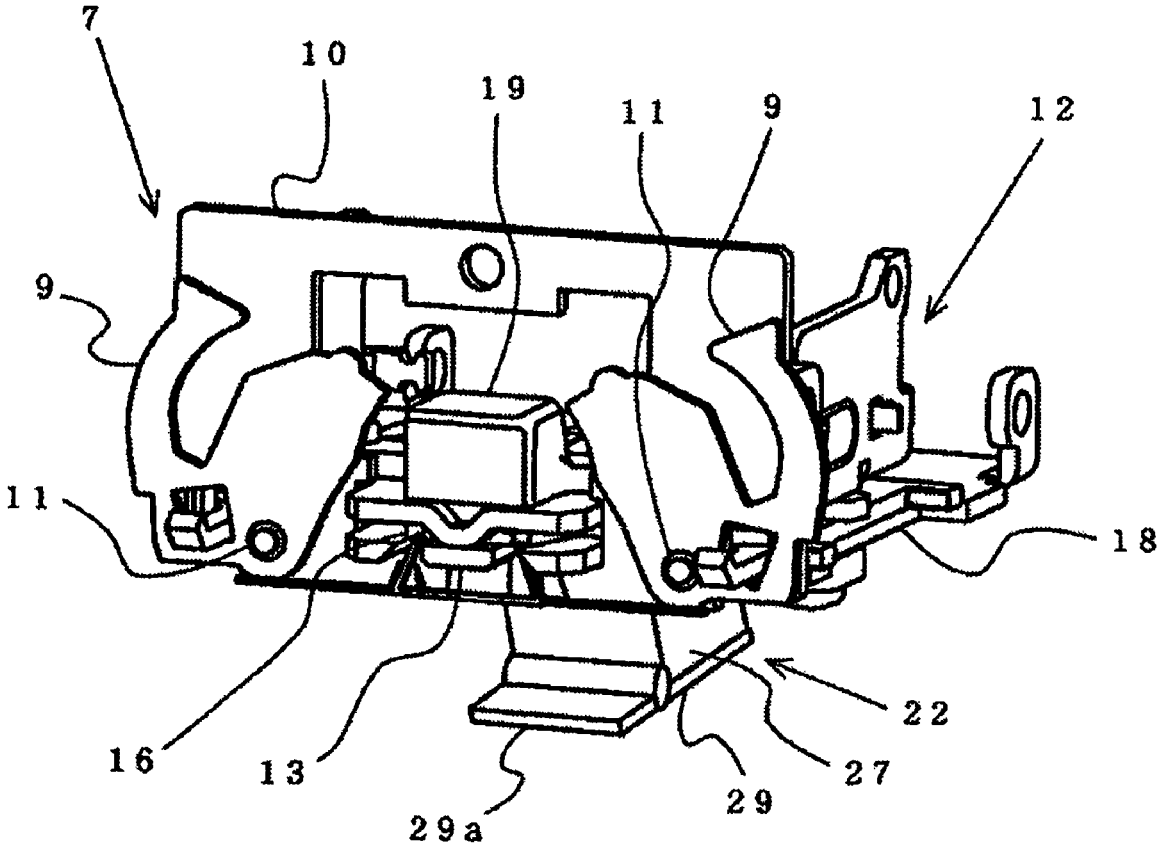
FIG. 3 is a perspective view showing an essential portion of a clincher mechanism portion of the stapler of FIG. 1.

An upper portion of the machine frame 2 is formed with a clincher mechanism portion 7 for bending a staple leg struck by the strike mechanism portion 5 and penetrated to a side of an upper face of the sheets arranged on the table 6 along the upper face of the sheets. According to the clincher mechanism portion 7, a rear end portion thereof is supported by a front end portion of a clincher frame 8 axially attached pivotably to the machine frame 2 by way of a pivoting shaft 8*a*. After arranging the sheets on the table 6, the clincher frame 8 is operated to pivot to pinch the sheets between an upper face of the table 6 and the clincher mechanism portion 7. As shown by FIG. 3, the clincher mechanism portion 7 is provided with a pair of movable clinchers 9 for engaging with staple legs penetrated through the sheets and projected to the upper face side of the sheets for bending the staple legs along the upper face of the sheets at a support plate 10 mounted to a front end portion of the clincher frame 8 respectively pivotably by pivoting shafts 11.

Figure 4:
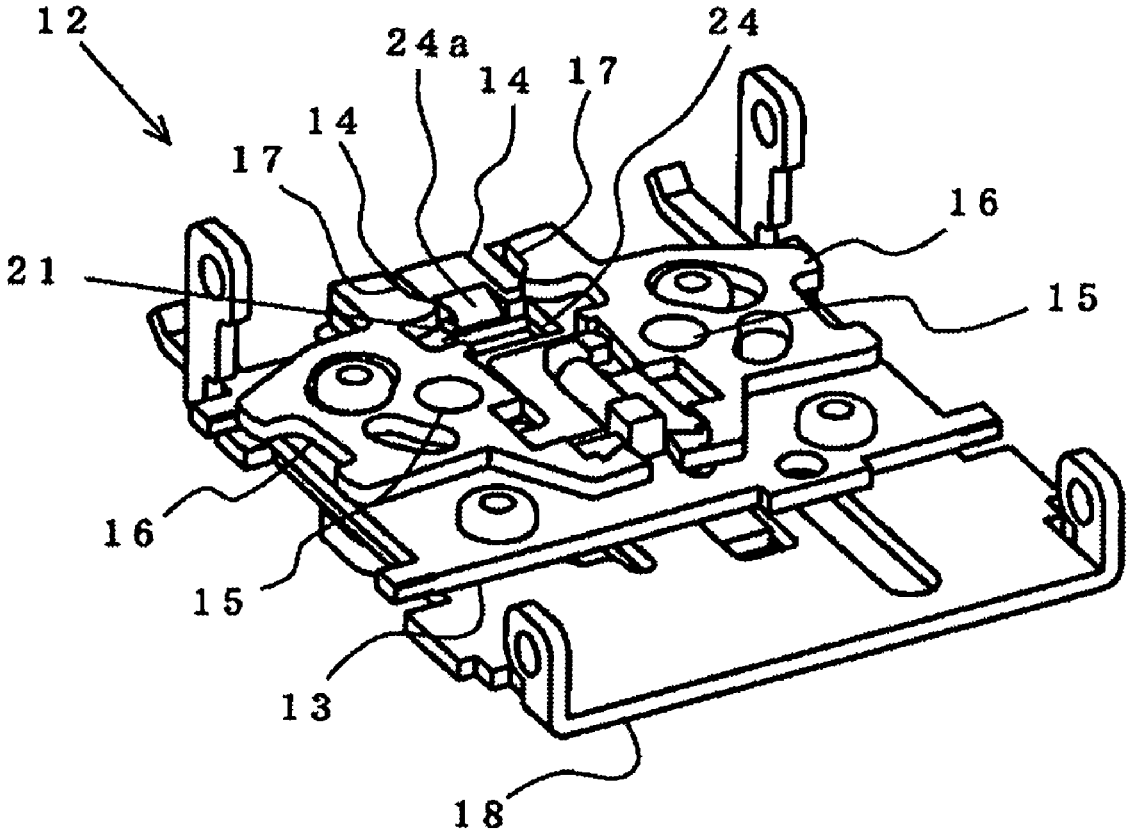
FIG. 4 is a perspective view showing a cutter unit of the stapler of FIG. 1.
Figure 5:
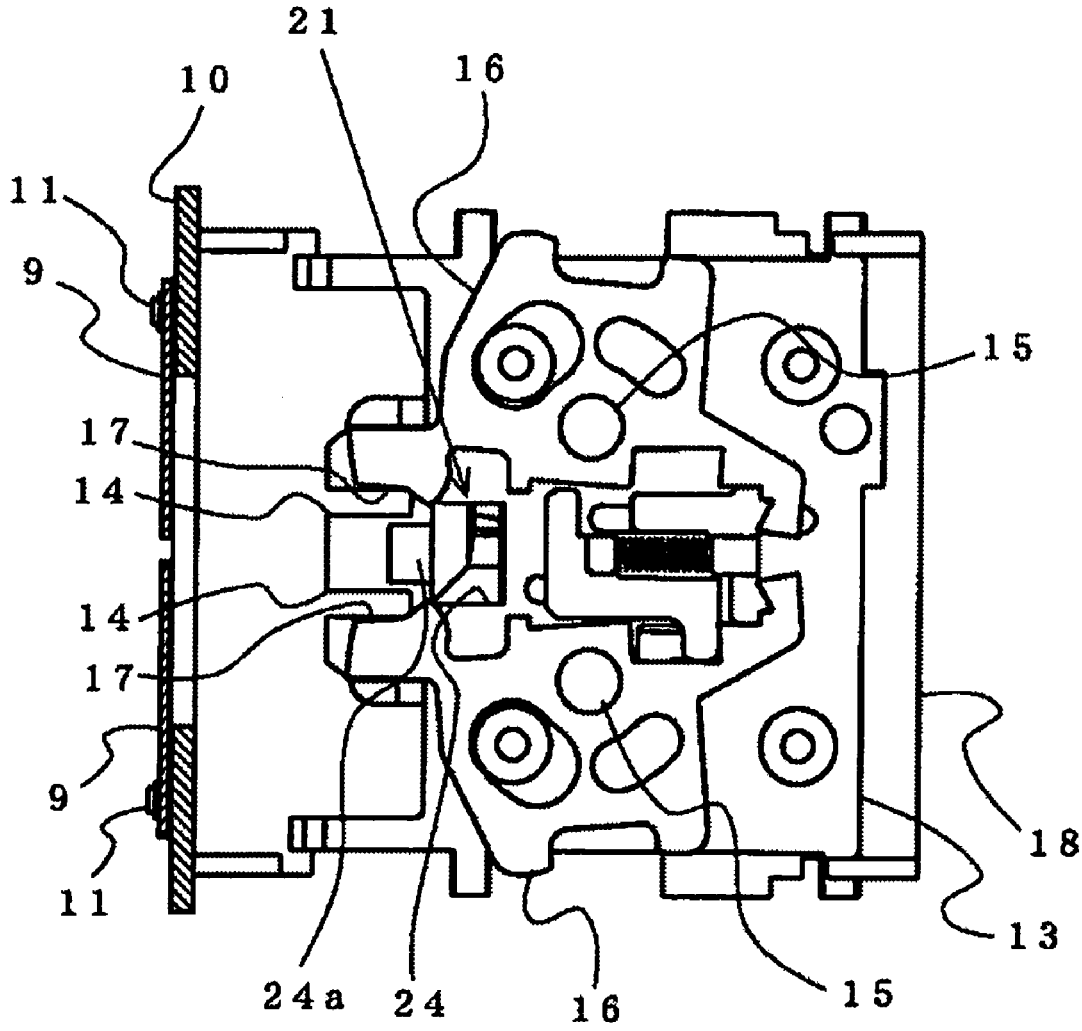
FIG. 5 is a plane view showing the cutter unit of FIG. 4 operated to an escaping position on a rear side.

Further, the clincher mechanism portion 7 is formed with a cutter unit 12 for cutting a leading end portion of the staple leg such that a length of a portion of the staple leg penetrated through the sheets and projected from the sheets is made to be a constant length. As shown by FIG. 4 and FIG. 5, the cutter unit 12 is constituted by a fixed cutter 13 in a plate-shape formed with a cut edge 14 arranged between the pair of staple legs projected to the upper face side of the sheets by penetrating the sheets at a leading end portion thereof, and a pair of movable cutters 16 pivotably supported centering on pivoting shafts 15 in a state of being brought into close contact with an upper face of the fixed cutter 13. Front ends of the pair of movable cutters 16 are formed with cut edges 17 opposed to the cut edge 14 of the fixed cutter 13. By pivoting the movable cutters 16 centering on the pivoting shafts 15, the leading end portions of the staple legs arranged between the respective cut edges 14, 17 are cut between the two cut edges 14, 17 to make the length of the staple legs projected to the upper face of the sheets constant.

The fixed cutter 13 in the plate-shape forming the cutter unit 12 is slidably supported by an upper face of the support base 18 formed on a rear side of the support plate 10 supporting the movable clincher 9. When the movable clincher 9 is pivoted to a standby position as shown by FIG. 3, portions of the respective cut edges 14, 17 of the fixed cutter 13 and the movable cutters 16 are arranged at front positions opposed to the staple struck out from the strike mechanism 3 as shown by FIG. 4. At the positions, the staple legs advancing to between the cut edges 14, 17 by penetrating the sheets are cut by pivoting the movable cutters 16 relative to the fixed cutter 13. Further, after cutting the staple legs S1, as shown by FIG. 5, the cutter unit 12 is slid to move to the rear side on the support base 18 to escape from a region of operating the movable clinchers 9. Thereby, the movable clinchers 9 bind the staple by bending the staple legs along a back face of the sheets without interfering with the cutter unit 12.

According to the stapler 1, staple members aligning a number of staple members in a straight shape to be connected by a flexible tape and wound in a spiral shape are charged to a staple cartridge 20. The staple cartridge 20 charged with the staple members is mounted to the stapler 1, the staple members drawn from the staple cartridge 20 are successively supplied to the striking portion, formed into the staples into a U-shape immediately before the striking portion and struck out to the sheets by the strike mechanism portion 5. The staple cartridge 20 is attachable and detachable to and from the stapler 1. After using up the staple members in the staple cartridge 20 charged to the stapler 1, the staple cartridge 20 is replaced to a new one of the staple cartridge 20 to replenish the staple members to the stapler 1.

Figure 6:
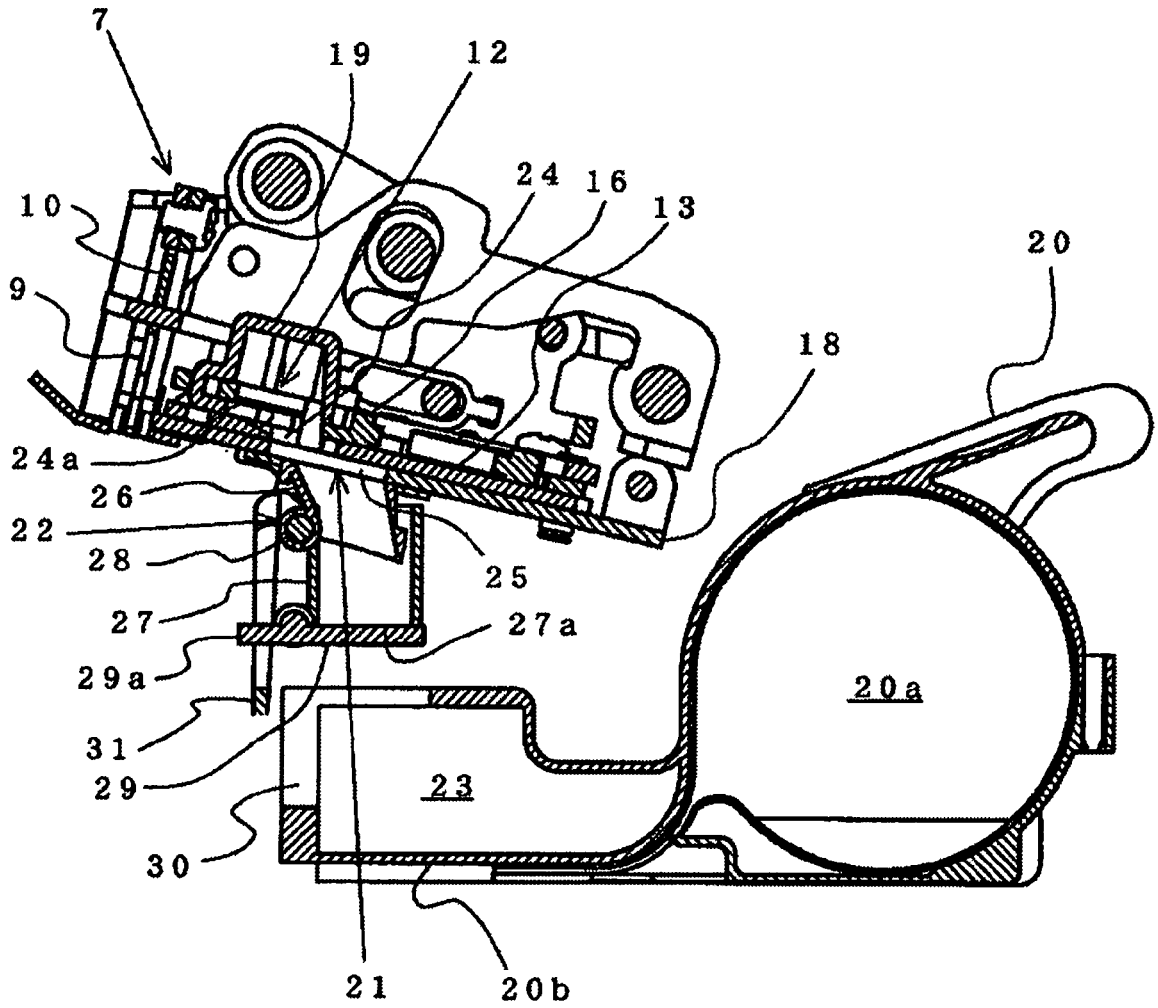
FIG. 6 is a vertical sectional side view showing a state of operating a chip processing apparatus in which the clincher mechanism portion is arranged at a standby position on an upper side.

Further, as shown by FIG. 6, the stapler 1 is formed with a chip processing apparatus for preventing a chip produced in cutting the staple leg by the cutter unit 12 from being scattered in the stapler 1. The chip processing apparatus is constituted by a discharging portion 21 formed at the cutter unit 12 for discharging the chip cut by the cutter unit 12 to a side of a lower face of the cutter unit 12, a chute 22 for guiding the chip discharged to the side of the lower face of the cutter unit 12 by way of the discharging portion 21 to direct in a lower direction, and a chip containing portion 23 formed at the staple cartridge 20 to contain the chip guided to the lower side by the chute 22. Further, numeral 19 designates a cover member arranged to cover upper portions of the respective cut edges 14, 17 of the fixed cutter 13 and the movable cutters 16, and the chip is prevented from being scattered in the stapler 1 by guiding the cut chip to the discharging portion 21 by the cover member 19.

The discharging portion 21 for discharging the chip of the staple leg to the side of the lower face of the cutter unit 12 is constituted by an opening 24 formed at the fixed cutter 13 in the plate-shape by being penetrated from the upper face side to the lower face side of the fixed cutter 13, and an opening 25 formed at the support base 18 slidably supporting the fixed cutter 13 by being penetrated from an upper face side to a lower face side of the support base 18. An edge on a front side of the opening 24 formed at the fixed cutter 13 is formed with an inclined face 24*a*. The chip cut by operating the movable cutters 16 is guided to the opening 24 by the inclined face 24*a*. By sliding to operate the cutter unit 12 arranged at the front position shown in FIG. 3 and FIG. 4 for cutting the staple leg to a rear side shown in FIG. 5 and FIG. 6 after cutting the staple leg, the opening 24 of the fixed cutter 13 and the opening 25 of the support base 18 are matched, and the chip cut by the pivoting the movable cutters 16 is discharged to the lower face side of the cutter unit 12 by way of the two openings 24, 25 constituting the discharging portion 21.

The chute 22 for guiding the chip discharged to the lower face of the cutter unit 12 from the discharging portion 21 to the chip containing portion 23 is constituted by a first chute 26 mounted to a back face of the support base 18 to cover the lower face side of the opening 25 formed at the support base 18, and a second chute 27 formed at a lower end of the first chute 26 in a shape of a cylinder pivotably supported by a pivoting support shaft 28. A lower end of the second chute 27 formed in the shape of the cylinder is formed with an opening portion 27*a* opened to direct in a lower direction. The opening portion 27*a* is provided with a lid member 29 normally urged to pivot to close the opening portion 27*a*. The chip discharged to the lower face side of the cutter unit 12 by way of the discharging portion 21 and guided to the first chute 26 is temporarily stored in the second chute 27.

As shown by FIG. 6, the staple cartridge 20 is formed with a containing portion 20*a* for containing the staple members wound in the spiral shape, and a staple guide portion 20*b* for guiding the staple member drawn from the containing portion 20*a* to the striking portion. The cut chip containing portion 23 is formed on an upper face of the staple guide portion 20*b*. The chip containing portion 23 is arranged at a position opposed to the lower end of the second chute 27 of the chute 22 formed at the lower face of the cutter unit 12 in a state of mounting the staple cartridge 20 to the stapler 1. Further, the chip containing portion 23 is formed with an opening 30 for making a lower end portion of the second chute 27 formed in the shape of the cylinder advance into the chip containing portion 23.

In a state of finishing the staple binding operation, as shown by FIG. 1, the clincher frame 8 is arranged at an upper position at which the clincher mechanism portion 7 supported by the clincher frame 8 is separated from the strike mechanism portion 5 by pivoting the clincher frame 8 in the clockwise direction centering on the pivoting support shaft 8*a*, under the state, as shown by FIG. 6, the lower end of the second chute 27 of the chute 22 formed on the lower face side of the cutter unit 12 is arranged at a position remote from the chip containing portion 23 formed at the staple cartridge 20 to an upper side. Further, the lid member 29 formed at the lower end of the second chute 27 closes the opening portion 27*a* of the second chute 27, and the chip of the staple leg cut by the staple binding operation at a preceding time is stored in the second chute 27. The lid member 29 is supported pivotably by the second chute 27.

Figure 7:
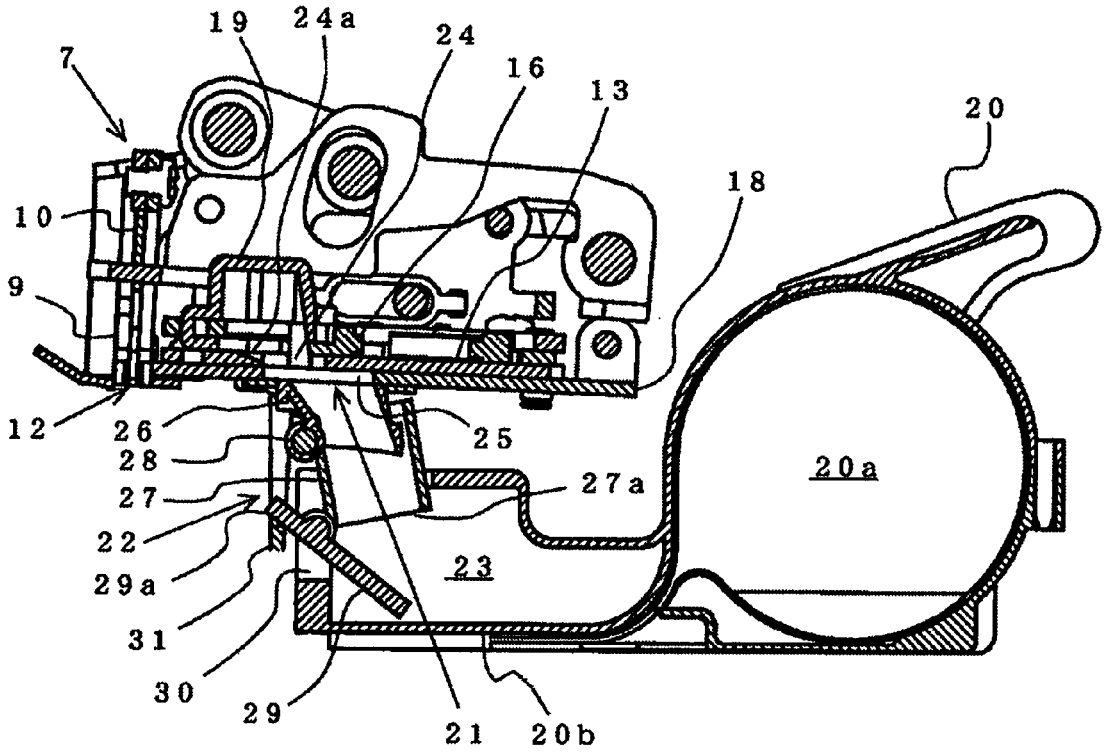
FIG. 7 is a vertical sectional side view showing a state of operating the chip processing apparatus in which the clincher mechanism portion is operated to an operating position on a lower side.

When the clincher mechanism portion 7 is arranged to be proximate to the strike mechanism portion 5 by being pivoted in the counterclockwise direction centering on the pivoting support shaft 8*a*, as shown by FIG. 7, the cutter unit 12 is pivoted in the lower direction along with the clincher mechanism portion 7, and the lower end of the second chute 27 of the chute 22 formed on the lower face side of the cutter unit 12 advances into the chip containing portion 23 from the opening 30 of the chip containing portion 23 formed at the staple cartridge 20. By pivoting the chute 22 in the lower direction along with the clincher mechanism portion 7 in this way, an end portion 29*a* of the lid member 29 formed at the lower end portion of the second chute 27 is pivoted by being engaged with the engaging portion 31 formed at the machine frame 2 to open the opening portion 27*a* at the lower end of the second chute 27, and the chip stored in the second chute 27 is discharged to the chip containing portion 23.

Although the staple cartridge 20 formed with the chip containing portion 23 according to the embodiment is formed with the containing portion 20*a* formed in the shape of the cylinder to contain the staples formed in a roll-shape by winding the staple members connected by the flexible connecting member in the spiral shape, in a stapler using connected staple members in a sheet-shape adhered to connect with staple members in a straight shape in a shape of a flat sheet by a predetermined number of pieces thereof, the invention can be embodied by forming a chip containing portion at a staple cartridge forming a containing portion in a shape of a square cylinder laminating to contain a number of the connected staple members in the sheet-shape.

Although an explanation has been given of the invention in details and in reference to the specific embodiment, it is apparent for the skilled person that the invention can variously be changed or modified without deviating from the spirit and the range of the invention.

The application is based on Japanese Patent Application (Japanese Patent Application No. 2004-363688) flied on Dec. 15, 2004, and a content thereof is incorporated herein by reference.

INDUSTRIAL APPLICABILITY

According to the chip processing apparatus of the staple leg of the embodiment, the chip containing portion 23 is formed at the staple cartridge 20 replaced after using the staple members, and the chip of the staple leg produced by operating the cutter unit 12 is collected into the chip containing portion 23. By replacing the staple cartridge 20 in order to replenish the staple, the chip stored in the chip containing portion 23 can be discharged from the stapler 1 or an apparatus including the stapler 1. Therefore, a volume of the chip containing portion 23 forming the staple cartridge 20 may be set in accordance with an amount of the staple members contained in the staple cartridge 20, it is not necessary to form the chip containing portion having a large capacity in the stapler 1 or a printer or a copier or a finisher or the like including the stapler 1, further, it is not necessary to form a mechanism for discharging the chip at a printer or a copier or a finisher or the like.

Further, the lower end of the second chute 27 formed in the shape of the cylinder of the chute 22 is formed with the opening portion 27*a*, the lid member 29 for closing the opening portion 27*a* of the second chute 27 is formed, the lower end portion of the second chute 27 advances into the chip containing portion 23 by operating the clincher mechanism portion 7, the chip stored in the second chute 27 is discharged to the chip containing portion 23 by opening the lid member 29. Therefore, the chip is not scattered in the stapler 1 or a printer or a copier or a finisher or the like, and an operational failure by the chip can be prevented from being brought about.

The invention claimed is:

1. A staple cartridge comprising:

a staple containing portion for containing a number of staples; and a chip containing portion for containing a chip of a cut staple leg, wherein the staple containing portion and the chip containing portion are formed integrally so that the chip containing portion is arranged at a position opposed to a cutter unit of a stapler, and wherein the chip containing portion formed integrally with the staple containing portion is adapted to mount attachably and detachably towards and away from the position opposed to the cutter unit of the stapler, such that when the number of staples in the staple containing portion is depleted and the staple containing portion is detached with the integrally formed chip containing portion away from the cutter unit of the stapler, the cut staple leg in the chip containing portion is removed simultaneously with the staple containing portion from the position opposed to the cutter unit.

2. The staple cartridge according to claim 1, further comprising:

a staple guide portion for guiding the staple drawn from the staple containing portion to outside of the staple cartridge, wherein the chip containing portion is formed on an upper face of the staple guide portion.

3. A staple leg chip processing apparatus comprising:

a strike mechanism portion for striking out a staple to sheets;

a cutter unit for cutting a leading end portion of a staple leg projected to a back face side of the sheets;

a clincher mechanism portion operably supported to be proximate and remote to and from the strike mechanism portion and for bending the staple leg along the back face of the sheets;

a chip containing portion for containing a chip of the cut staple leg and arranged at a position opposed to the cutter unit; and a chute formed at the cutter unit for guiding the chip to the chip containing portion;

wherein the chip containing portion is provided integrally with a staple containing portion for containing the staple to form a staple cartridge mounted attachably and detachably to and from the position opposed to the cutter unit such that when the staples in the staple containing portion are depleted and the staple containing portion is detached with the integrally formed chip containing portion, the cut staple leg in the chip containing portion is removed from the position opposed to the cutter unit simultaneously with the staple containing portion.

4. The staple leg chip processing apparatus according to claim 3, wherein the cutter unit is provided at the clincher mechanism portion.

5. The staple leg chip processing apparatus according to claim 3, wherein the chute is formed in a shape of a cylinder formed with an opening portion directed in a lower direction;

the opening portion is provided with an opening and closing lid closed normally;

the chip is deposited in the chute;

when the clincher mechanism portion moves to a direction of the staple strike mechanism portion, a lower end portion of the chute advances into the chip containing portion; and by operating the clincher mechanism portion to be proximate to the staple strike mechanism portion, the opening portion is opened, and the chip deposited in the chute is discharged to the chip containing portion.

6. The staple leg chip processing apparatus according to claim 5, wherein the opening and closing lid is pivotably supported on the chute; and when the clincher mechanism portion is operated to be proximate to the staple strike mechanism portion, the opening portion is opened by engaging an end portion of the opening and closing lid with an engaging portion formed at a machine frame pivotably supporting the clincher mechanism portion.

7. The staple leg chip processing apparatus according to claim 3, wherein the chute comprises:

a first chute fixed to a lower face side of the clincher mechanism portion; and a second chute pivotably supported on the clincher mechanism portion by a pivoting support shaft.

8. The staple leg chip processing apparatus according to claim 7, wherein the second chute is formed in a cylindrical shape, the chip containing portion includes an opening, and a lower end portion of the second chute advances into the opening of the chip containing portion.

9. The staple leg chip processing apparatus according to claim 3, further comprising:

a staple guide portion for guiding the staple drawn from the staple containing portion to the strike mechanism portion, wherein the staple guide portion is provided in the staple cartridge, and the chip containing portion is formed on an upper face of the staple guide portion.

* * * * *